US007024894B2

(12) United States Patent
Salonen

(10) Patent No.: US 7,024,894 B2
(45) Date of Patent: Apr. 11, 2006

(54) SAFETY STORAGE DEVICE

(75) Inventor: Arto Salonen, Tampere (FI)

(73) Assignee: S.I. Treducon Oy, Tampere (FI)

( * ) Notice: Subject to any disclaimer, the term of this patent is extended or adjusted under 35 U.S.C. 154(b) by 0 days.

(21) Appl. No.: 10/883,725

(22) Filed: Jul. 6, 2004

(65) Prior Publication Data

US 2005/0006993 A1 Jan. 13, 2005

Related U.S. Application Data

(63) Continuation of application No. PCT/FI03/00121, filed on Feb. 19, 2003.

(30) Foreign Application Priority Data

Feb. 20, 2002 (FI) ..... 20020341

(51) Int. Cl.
*E00B 69/00* (2006.01)

(52) U.S. Cl. ..... 70/58; 70/19; 211/4; 211/8

(58) Field of Classification Search ..... 292/259 R, 292/289, 290, 292, 342, 343; 211/4, 6, 8, 211/9; 70/19, 58–60, DIG. 41
See application file for complete search history.

(56) References Cited

U.S. PATENT DOCUMENTS 501,972 A * 7/1893 Twose ..... 211/8
725,441 A * 4/1903 Hart ..... 211/8
880,232 A * 2/1908 McNearney ..... 211/8
1,042,502 A * 10/1912 Thompson ..... 70/19
1,072,559 A * 9/1913 Bacon ..... 70/19
1,079,655 A * 11/1913 Lissner ..... 70/38 C
2,171,682 A 9/1939 Byrnes ..... 70/59
3,615,114 A * 10/1971 Harris ..... 292/288
5,238,213 A * 8/1993 Pool ..... 248/352
5,573,098 A * 11/1996 Widmer ..... 194/212
5,917,407 A * 6/1999 Squire et al. ..... 340/432
6,491,169 B1 * 12/2002 Salonen ..... 211/4

FOREIGN PATENT DOCUMENTS

DE 224415 7/1910
DE 379575 8/1923
WO WO 90/07046 6/1990

* cited by examiner

*Primary Examiner*—Suzanne Dino Barrett
(74) *Attorney, Agent, or Firm*—Young & Thompson

(57) ABSTRACT

A safety storage device (1) comprising a frame (2), a first contact surface (6), a locking member (3) arranged movable relative to the frame (2), a second contact surface (7) at a first end of the locking member (3), and a locking device (4). An article (10) to be locked is arranged between the contact surfaces (6, 7), and the locking member (3) is then moved towards the first contact surface (6) so as to engage the article (10) to be locked between the contact surfaces (6, 7). When locked, the locking device (4) acts on the locking member (3) by being arranged to prevent the movement of the locking member (3) away from the first contact surface (6).

10 Claims, 4 Drawing Sheets

SAFETY STORAGE DEVICE

This application is a Continuation of International Application PCT/FI03/00121 filed on 19, Feb. 2003, which designated the U.S. and was published under PCT Article 21(2) in English.

FIELD OF THE INVENTION

The invention relates to a safety storage device for locking articles, the safety storage device comprising at least: a frame; a first contact surface and a second contact surface; a locking member at whose first end the second contact surface is arranged, the locking member being arranged movable relative to the frame such that an article to be locked is lockable between the first contact surface and the second contact surface by moving the locking member towards the first contact surface; a locking device, which, when locked, is arranged to prevent the locking member from being moved away from the first contact surface, and the locking device being openable by means of a predetermined identifier for releasing the movement of the locking member, in which safety storage device: the locking member comprises a shaft portion on which the locking device is arranged to act; the locking member is arranged movable by subjecting it to a force that is substantially longitudinal to said shaft portion; and further the locking device comprises a locking piece arranged between the frame and the locking member.

BACKGROUND OF THE INVENTION

There is need for a secure storage for temporarily storing the clothes and other articles of visitors in restaurants, theatres, concert and sports halls, reception areas of companies, etc. However, arranging a supervised coatroom is expensive and impossible in all locations because of lack of space, for example. Consequently, various lockable garment racks have been developed for visitors to lock their garments in.

U.S. Pat. No. 725,441 discloses a rack comprising a C-shaped bracket. The garments are clamped between a fixed disk at a lower arm and a second disk arranged in a movable arm. However, the rack disclosed is slow and difficult to use, since the required pressing movement is provided by rotating the arm around its shaft. Moreover, locking is difficult since it requires the use of a separate padlock.

WO publication 90/07046 discloses an apparatus for locking clothes and comprising a fixed contact surface and a movable contact surface. The movable contact surface is movable towards the fixed contact surface by means of a screw mechanism, allowing a garment arranged between the contact surfaces to be pressed between them. The use of the screw mechanism can be disabled with the locking apparatus to prevent unauthorized release of the pressing. The problem in this apparatus is the slow and cumbersome movement of the contact surface by means of the screw mechanism.

U.S. Pat. No. 892,407 discloses a rack comprising a C-shaped frame. The upper frame is tubular and an arc-shaped rod is arranged slidingly relative thereto, a contact surface at the outmost end of the rod being movable against the fixed contact surface in the lower frame for engaging the garment between the contact surfaces. A locking device fastened to the frame comprises a locking plate arranged to fit in a groove in the arm of the arc-shaped rod when the rod is moved into a predetermined locking position. The drawback in such a solution is that the rod is lockable only in a given position, determined by the location of the groove provided in the rod. Consequently, the rack is suitable only for the locking of articles of a given thickness.

BRIEF DESCRIPTION OF THE INVENTION

The object of the present invention is to provide a new and improved lockable device for safe storage of various articles.

The safety storage device of the invention is characterized in that the locking piece is arranged to be pressed against the shaft portion of the locking member when the locking device is locked and to generate a friction force to prevent the locking member from moving.

An essential idea of the invention is that the locking member comprises a shaft portion on which the locking piece included in the locking device is arranged to act. The locking piece is arranged between the frame and the locking member in a manner allowing it to be pressed against said shaft by means of a suitable actuator upon locking. This results in a friction force being created between the locking piece and the locking member by the action of the pressing, the force preventing the locking member from moving away from the first contact surface.

An advantage of the invention is that it can be used in many ways for locking articles of variable thickness and structure, for example, since the locking member is steplessly lockable into the desired position. The safety storage device of the invention is also simple and fast to use. In addition, the structure is simple and inexpensive to manufacture, and it resists wear well.

The essential idea of an embodiment of the invention is that the locking piece is supported at a first end to the frame and the locking piece is rotatable relative to a support point. The locking piece is provided with a transverse opening, through which the shaft portion of the locking member is arranged. The locking takes place by the locking piece being turned into an oblique position, whereby the edges of the opening in the locking piece are wedged against the shaft of the locking member. Such a solution is simple and inexpensive to manufacture. Furthermore, the force acting on the locking piece may be quite small and yet it achieves a high friction force and a reliable locking.

The essential idea of an embodiment of the invention is to carry out the locking by means of one or more wedge-shaped locking pieces. The locking piece may be inserted into a gap between the frame and the locking member in such a manner that it is tightly wedged against the shaft portion of the locking member thus preventing the locking member from being moved. Selecting a suitably wedge-shaped locking piece results in the force required to move the locking piece being relatively low.

The essential idea of an embodiment of the invention is to allow the locking piece to be moved towards the first contact surface when locked. This allows the locking to be performed by first using an identifier, such as a key, the locking member then being pushed into the locking position. In some cases, this may make the locking of articles easier and faster.

BRIEF DESCRIPTION OF THE FIGURES

The invention will be described in detail in the accompanying drawings, in which.

For the sake of clarity, the figures show the invention in a simplified manner. In the figures, like references indicate like parts.

DETAILED DESCRIPTION OF THE INVENTION

Figure 1:
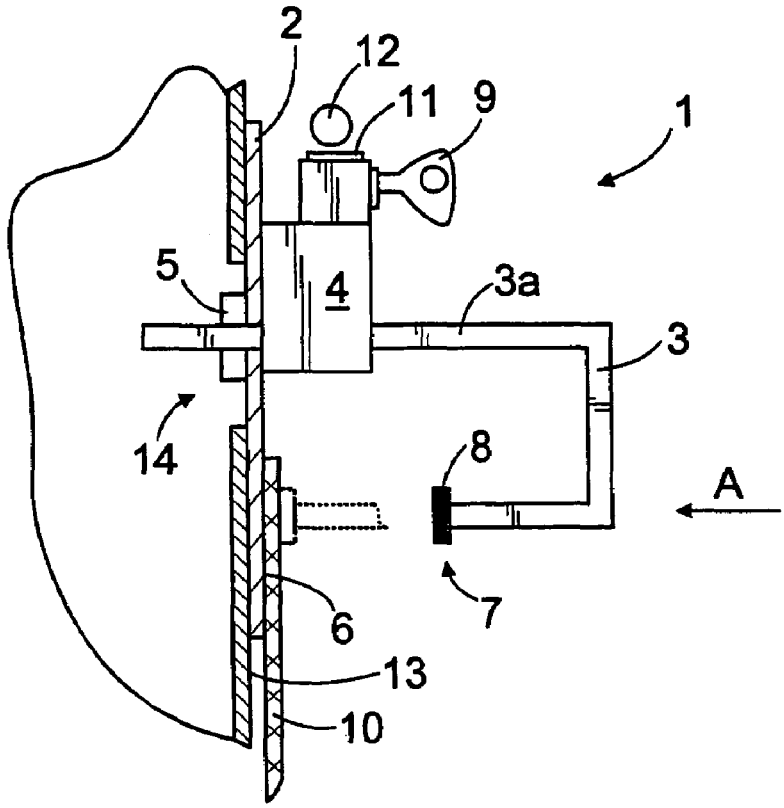
FIG. 1 is a schematic partially cross-sectional side view of a safety storage device of the invention.
Figure 9:
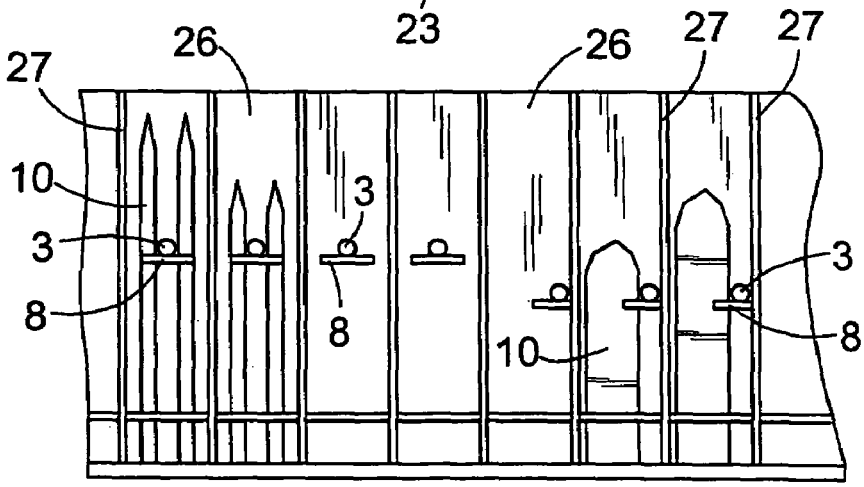
FIG. 9 is a schematic front view of safety storage devices of the invention, suitable for locking skiing equipment.
Figure 10:
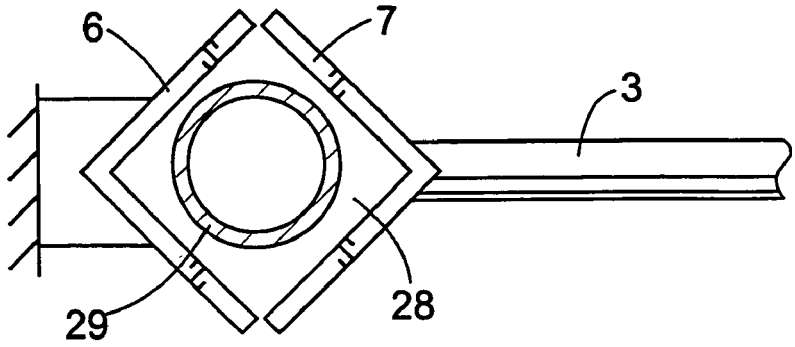
FIG. 10 is a schematic side view of another alternative for shaping contact surfaces.

FIG. 1 shows a safety storage device 1 comprising a frame 2, a locking member 3 movably arranged in the frame 2, and a locking device 4. In the embodiment of FIG. 1, the locking member 3 is a substantially U-shaped piece supported to the frame 2 by means of suitable bearing members 5. The locking member 3 is made from metal or another sufficiently rigid material, so that it retains its shape even if forces are applied thereto. Furthermore, the locking member 3 is prevented from being rotated relative to the frame 2 for instance by the locking member 3 having a cross section that is not rotationally symmetric, e.g. angular. Furthermore, the frame 2 is provided with a first contact surface 6. The first contact surface 6 is typically fixed, but, if required, it can be formed adjustable. If required, the first contact surface 6 may be roughened or coated with a suitable material for securing the fastening of lockable articles. A first end of the locking member 3 is provided with a second contact surface 7. The second contact surface 7 may be provided with a squeeze head 8, whose shape, material and other properties may be tailored for locking certain articles. Consequently, in a device intended for clothing, the squeeze head 8 is preferably of an elastic material that presses together to some degree to prevent the clothing from being damaged. Furthermore, for articles having a slippery surface, a rubber squeeze head 8, for example, can be selected, thus achieving the necessary friction between the article to be locked and the second contact surface 7. Below, FIGS. 9 and 10 show still some further examples of squeeze heads 8.

The safety storage device 1 shown in FIG. 1 operates by the locking device 4 being activated by using a key 9. The key 9 is removed from the locking device 4. An article 10 to be locked, in this case a garment, is arranged in a gap between the first contact surface 6 and the second contact surface 7. The locking member 3 is then pushed manually in direction A towards the first contact surface 6. The locking member 3 then moves in the position shown by a broken line in FIG. 1, and presses the article 10 to be locked against the first contact surface 6, whereby necessary friction is generated between the article 10 to be locked and the contact surfaces 6 and 7. The article 10 to be locked cannot be removed from between the first contact surface 6 and the second contact surface 7 without releasing the press by moving the locking member 3 away from the first contact surface 6. When the article 10 to be locked is to be released, the locking device 4 is opened with the key 9, whereupon the locking member 3 can be manually pulled back. A spring can be arranged in connection with the locking member 3 for automatically returning the locking member 3 to the posterior position once the locking device 4 is opened.

When locked, the locking device 4 is arranged to prevent the locking member 3 from being moved away from the first contact surface 6, and thus the locking device 4 has to be opened by using a predetermined identifier, in this case the key 9, to remove the article 10 to be locked from the safety storage device 1. However, the locking device 4 can be designed to enable the movement of the locking member 3 towards the first contact surface 6, when locked. This allows the user to easily hold the article 10 to be locked in place with one hand between the contact surfaces 6, 7, and simultaneously push the locking member 3 with the other hand towards the first contact surface 6 to achieve the necessary pressing force. The locking device 4 is preferably able to lock the locking member 3 steplessly at the desired distance from the first contact surface 6. Some alternative constructions of the locking device 4 of the invention are shown in FIGS. 3 to 7.

The locking device 4 shown in FIG. 1 also comprises an automated payment machine 11 operating with coins 12 in this case. Alternatively, the automated payment machine 11 may receive tokens, it may read electronic charge cards or the machine may receive a payment transmitted thereto by a mobile phone, for example. Once the payment is received, the locking device 4 can be activated by the key 9 or the like. Before the payment is made, the locking device 4 cannot be locked. Alternatively, the locking device 4 retains the locking member 3 in the extreme open position until the payment is made.

Figure 2:
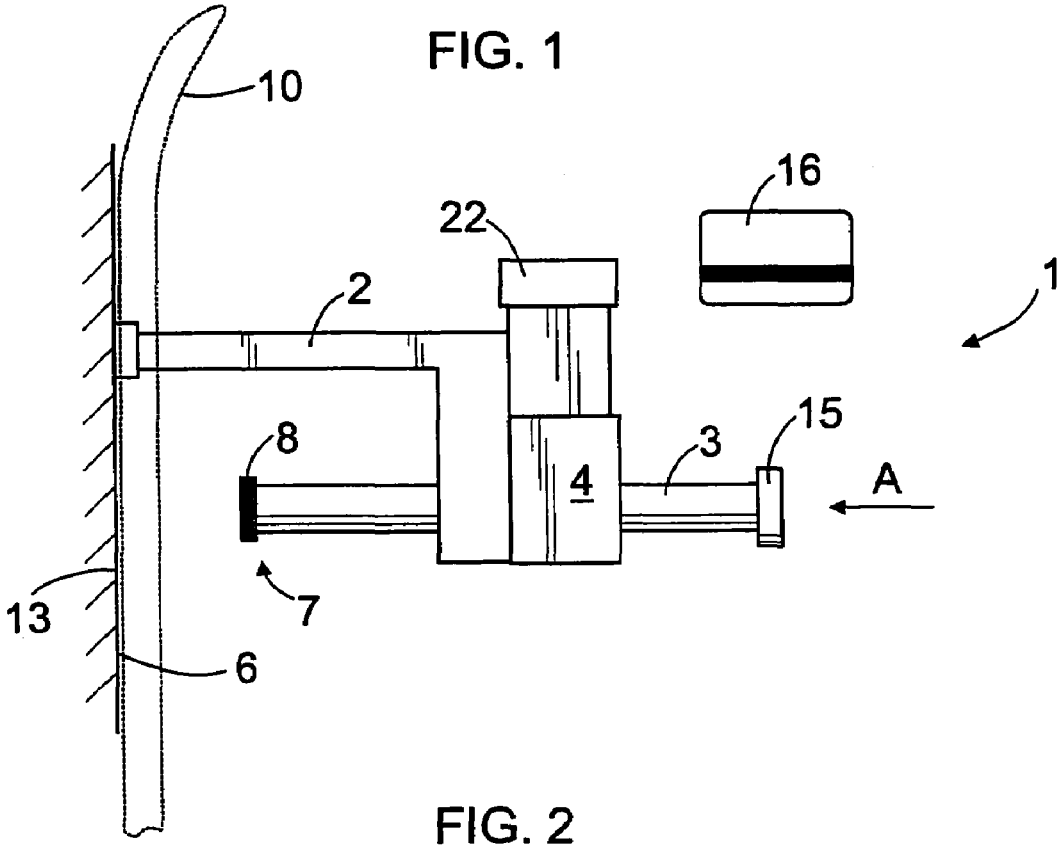
FIG. 2 is a schematic side view of a second safety storage device of the invention.

The safety storage device 1 shown in FIG. 1 is fastened to a wall surface 13, which may be a fixed wall in a building or the surface of a suitable movable structure, for example. The wall surface 13 is provided with an opening 14 to allow a second end at the longer branch 3*a* of the U-shaped locking member 3 to extend to the other side of the wall surface 13. The safety storage device 1 shown in FIG. 2, in contrast, is arranged to move only on one side of the wall surface 13, making it easy to install in different places. In the solution of FIG. 2, the wall surface 13 also acts as the first contact surface 6.

In FIG. 2, the locking member 3 is an elongated bar, whose first end is provided with a squeeze head 8 serving as the second contact surface 7. The other end of the locking member 3 comprises an extension 15 for facilitating the pushing of the locking member 3 manually towards the first contact surface 6. In FIG. 2, the article 10 to be locked is a ski that is pressed against the wall surface 13, acting as the first contact surface 6, by means of the locking member 3. The locking device 4 comprises a reading device 22, arranged to identify an electronic card 16 used as the key. An alternative is to provide the locking device 4 with means for inputting an identification number.

Figure 3:
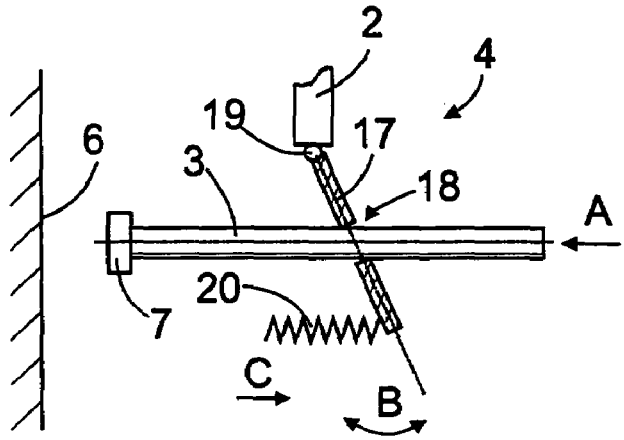
FIG. 3 is a schematic side view of a locking device of the safety storage of the invention in a locked position.
Figure 4:
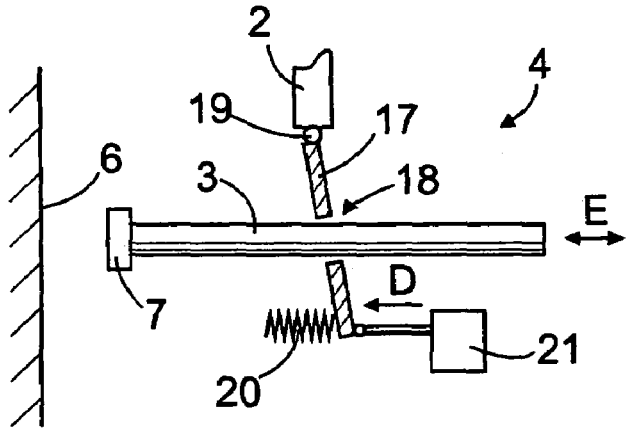
FIG. 4 is a schematic side view of the principle of the locking device of FIG. 3 in an opened position.

FIGS. 3 and 4 show the principle of a locking device 4. The locking member 3 can be a bar as shown in FIGS. 3 and 4 or a substantially U-shaped arm as shown in FIG. 1, the locking device 4 being arranged at the longer shaft portion, i.e. branch 3*a*, of the arm. The locking device 4 comprises a locking piece 17, which may be for instance a suitable bar-like or plate-like structure. The locking piece 17 comprises an opening 18 transverse to its axis. The opening 18 is dimensioned larger than the cross section of the locking member 3. Let it be mentioned that, alternatively, the locking piece 17 may be provided with a notch-like opening that opens to its outer edge and corresponds functionally to the closed opening shown in FIG. 3. The locking piece 17 is arranged transverse to the axis of the locking member 3, the locking member 3 passing through the loose opening 18. Furthermore, the first end of the locking piece 17 is supported to the frame 2 by means of a joint 19, allowing the locking piece 17 to be rotated in direction B relative to said joint 19. In FIG. 3, the locking piece 17 is in a locked position, i.e. a spring 20 is used to subject it to a spring force that pushes the second end of the locking piece 17 in direction C away from the first contact surface 6. In this case, the locking piece 17 is in an oblique position relative to the axis of the locking member 3, the edges of the opening 18 being wedged tightly against the outer surface of the shaft portion of the locking member 3. This results in a high surface pressure being generated between the locking piece 17 and the locking member 3, and, as a result, a high friction force capable of retaining the movement of the locking member 3 away from the first contact surface 6. Even if the spring force were relatively low and the friction coefficient between the locking member 3 and the locking piece 17 relatively small, the solution presented enables the generation of a sufficient locking force. Should the locked locking member 3 be forcefully moved away from the first contact surface 6, this force causes the locking piece 17 to tend to rotate to a more oblique position relative to the joint 19, whereby it is wedged increasingly more tightly against the outer surface of the locking member 3. This causes a larger surface pressure to be generated between the locking member 3 and the locking piece 17. When the locking member 3 is subjected to a force that tends to move it in direction A towards the first contact surface 6, the spring 20 allows the second end of the locking piece 17 to move towards the first contact surface 6, whereby the pressing between the locking member 3 and the locking piece 17 decreases and the shaft of the locking member 3 is able to slide relative to the opening 18. Any mechanic, electric or pressure medium-driven spring means, suitable for the purpose, can be used.

In FIG. 4, the free end of the locking piece 17 is moved by means of an opening device 21 in direction D towards the first contact surface 6 in such a manner that the opening 18 is loosely around the locking member 3. This way the locking member 3 is able to move longitudinally E substantially unrestrictedly relative to the locking piece 17. The edges of the opening 18 are not pressed against the shaft of the locking member 3. Since the spring force required in the locking is not high, the force achieved by the opening device 21 can be relatively low. The opening device 21 may be for instance a suitable lever turned with the key 9. Alternatively, the opening device 21 may be for instance an electric actuator.

In some cases, other types of actuators can be used instead of the spring 20, if it is not necessary to enable the pushing of the locking member 3 towards the first contact surface 6 after the locking. In this case, the opening device 21 can serve as the actuator and it can be arranged to move the locking piece 17 into the open position and, on the other hand, to keep the locking piece 17 wedged against the shaft portion of the locking member 3 when the locking device 4 is locked.

Figure 5:
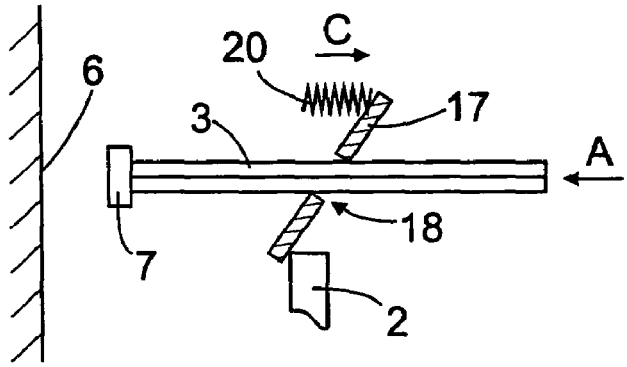
FIG. 5 is a schematic side view of the principle of a second locking device of the invention in a locked position.

In FIG. 5, the first end of the locking piece 17 comprises no joint, but it is supported directly against the frame 2. However, the locking takes place in the same way as is shown in FIGS. 3 and 4. For the sake of clarity, the opening device 21 is not shown.

As for the locking principle shown in FIGS. 3 to 5, the cross section of the shaft of the locking member 3 has no essential significance. In FIGS. 3 and 4, the cross section of the shaft of the locking member 3 is round, whereas in FIG. 5 the cross section of the shaft is angular. Furthermore, the outer surface of the shaft of the locking member 3 can be surface-treated to be resistant to wear, for example chromium plated. The high surface pressure achieved with the locking piece 17 ensures the necessary locking force even in this case.

Figure 6:
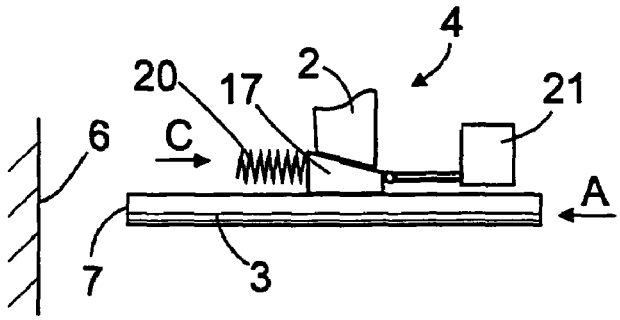
FIG. 6 is a schematic side view of the principle of a locking device of the invention applying a wedge-shaped locking piece, in a locked position.

FIG. 6 shows a locking device 4 having a wedge-shaped locking piece 17. The locking piece 17 is arranged such that the end having a larger cross section is closer to the first contact surface 6. Between the locking member 3 and the frame 2 is a gap, into which the spring 20 pushes the locking piece 17 in direction C, the locking piece 17 being tightly pressed against the outer surface of the locking member 3. The frame 2 preferably has a wedge-shaped contact surface. If attempts are made in the locked position to pull the locking member 3 away from the first contact surface 6, an increasingly higher locking force is generated as the locking piece 17 is wedged between the frame 2 and the locking member 3. If, again, the locking member 3 is pushed in direction A towards the first contact surface 6, the spring 20 allows the locking piece 17 to move in direction A, allowing the locking member 3 to move towards the first contact surface 6. In some embodiments, the spring 20 can be omitted, whereby the locking piece 17 is moved to the locking position by means of a suitable actuator. Furthermore, it is possible to arrange the wedge-shaped locking piece 17 contrary to what is shown in FIG. 6, i.e. the narrower end towards the first contact surface 6.

Figure 7:
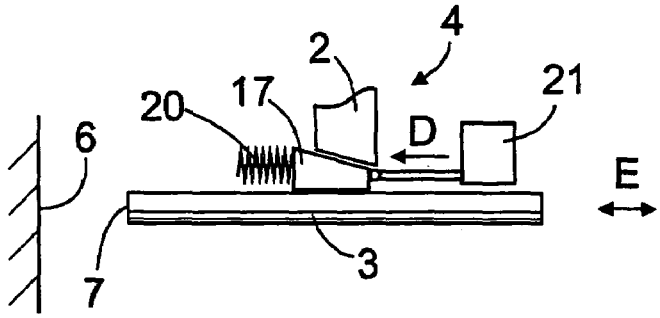
FIG. 7 is a schematic side view of the locking device of FIG. 6 in an opened position.

In FIG. 7, the wedge-shaped locking piece 17 is pushed by means of the opening device 21 in direction D towards the first contact surface 6, whereby the locking piece 17 is no longer wedged in the gap between the frame 2 and the locking member 3, but allows a longitudinal E movement of the locking member 3.

Figure 8:
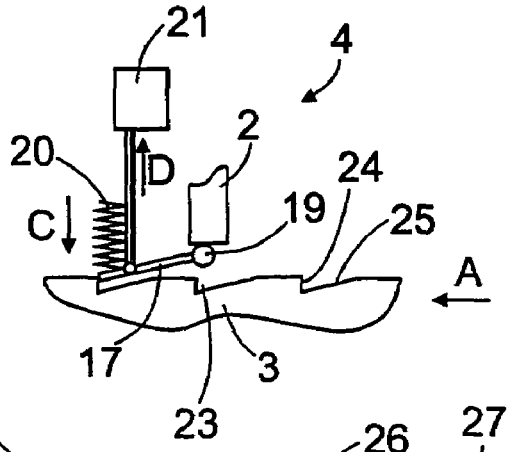
FIG. 8 is a schematic side view of the principle of a locking device of an alternative solution, i.e. applying the ratchet mechanism, in a locked position.

FIG. 8 shows an alternative locking device 4, whose operation is based on the ratchet mechanism. In this case, the outer surface of the locking member 3 is provided with grooves 23, whose first flank 24 on the side of the first contact surface 6 is substantially perpendicular to the axis of the locking member 3. A second flank 25 of the grooves 23 is oblique. In this case, the second end of the locking piece 17 can be supported against the first flank 24 of the groove, when being acted upon by means of the spring 20 in direction C. As distinct from the previous FIGS. 3 to 7, the locking is based on shape locking, not the friction between the locking piece and the locking member. The first end of the locking piece 17 is rotatably supported to the frame by means of the joint 19. Such a ratchet mechanism allows the locking member 3 to be pushed substantially freely in direction A towards the first contact surface 6. As distinct from the solutions shown in FIGS. 3 to 7, the locking away from the first contact surface 6 takes place step by step based on the distance between the grooves 23. The mechanism of FIG. 8 is well suited to situations where the lockable article does not have to be pressed by a force of an exact magnitude between the contact surfaces. It is applicable together with the shaped contact surfaces shown in FIG. 10, for example. When the locking device 4 shown in FIG. 8 is opened, the second end of the locking piece 17 is moved away from the groove 23 by means of the opening device 21. It is apparent to a person skilled in the art that the structure of the ratchet mechanism, known per se, can be other than is shown in FIG. 8. Accordingly, the grooves 23 may be arranged in a ratchet wheel, arranged to rotate around its axis, the ratchet wheel being coupled to the locking member 3 by means of suitable transmission members in such a way that moving the locking member 3 causes the ratchet wheel to rotate around its axis.

FIG. 9 shows several safety storage devices 1 arranged next to each other for locking ski gear. The safety storage devices 1 may have a common frame 2. The frame 2 comprises a rear wall 26, simultaneously serving as the first contact surface 6 of each device 1. Separating walls 27 for defining the locking spaces of the devices 1 laterally are arranged to project from the rear wall 26. Each locking space comprises a locking member 3, movable in accordance with the inventive principle and by moving which the skis and snowboards can be pressed and locked between the rear wall 26 and the squeeze head 8 in the locking member 3. For the sake of clarity, the figure does not show the locking devices.

FIG. 10 shows part of a safety storage device 1 suitable for locking bicycles, for example. The first contact surface 6 and the second contact surface 7 are designed to define a space 28 between them when arranged opposite each other. This allows a bicycle frame 29, for example, to be locked between the contact surfaces 6 and 7 without the contact surfaces 6 and 7 having to be pressed tightly against the article to be locked. This avoids any damage possibly caused by the pressing to sensitive painted surfaces, for example.

The drawings and the related description are only intended to illustrate the inventive idea. The details of the invention may vary within the scope of the claims. Consequently, the inventive idea can also be applied to such safety storage devices, in which the locking member is transferred to the locking position by means of an electric or medium-driven actuator. In this case, the actuator does not have to receive locking forces, but it may serve only as a transfer device for the locking member.

What is claimed is:

1. A safety storage device for locking articles, the safety storage device comprising at least:

a frame;

a first contact surface and a second contact surface;

a locking member at whose first end the second contact surface is arranged, the locking member being arranged movable relative to the frame such that an article to be locked is lockable between the first contact surface and the second contact surface by moving the locking member towards the first contact surface;

a locking device, which, when locked, is arranged to prevent the locking member from being moved away from the first contact surface, and the locking device being openable by means of a predetermined identifier for releasing the movement of the locking member, in which safety storage device:

the locking member comprises a shaft portion on which the locking device is arranged to act;

the locking member is arranged movable by subjecting it to a force that is substantially longitudinal to said shaft portion; and further the locking device comprises a spring member and a wedge-shaped locking piece moveably arranged in a gap between the frame and the locking member; the spring member being arranged to push the locking piece into said gap, and wherein the locking piece is arranged: i) to be wedged directly against the shaft portion of the locking member when the locking device is locked, and ii) to generate a friction force between the locking piece and the locking member to prevent the locking member from moving.

2. A safety storage device as claimed in claim 1, wherein the end of the wedge-shaped locking piece having a larger cross section is at a shorter distance from the first contact surface than the end having a smaller cross section, the spring member is arranged to push the locking piece away from the first contact surface when the locking device is locked, and the longitudinal force effect applied to the locking member towards the first contact surface is arranged to make the locking piece move towards the first contact surface thus releasing the wedging between the locking member and the locking piece and thus allowing the locking member to move towards the first contact surface.

3. A safety storage device as claimed in claim 1, wherein the locking device comprises a mechanical lock, which is openable with a key.

4. A safety storage device as claimed in claim 1, wherein the locking device comprises a reading device for reading an electronic identifier.

5. A safety storage device as claimed in claim 1, wherein the locking device comprises an automated payment machine.

6. A safety storage device for locking articles, the safety storage device comprising at least:

a frame;

a first contact surface and a second contact surface;

a locking member at whose first end the second contact surface is arranged, the locking member being arranged movable relative to the frame such that an article to be locked is lockable between the first contact surface and the second contact surface by moving the locking member towards the first contact surface;

a locking device, which, when locked, is arranged to prevent the locking member from being moved away from the first contact surface, and the locking device being openable by means of a predetermined identifier for releasing the movement of the locking member, in which safety storage device:

the locking member comprises a shaft portion on which the locking device is arranged to act;

the locking member is arranged movable by subjecting it to a force that is substantially longitudinal to said shaft portion; and further the locking device comprises a locking piece arranged between the frame and the locking member and wherein the locking piece is arranged: i) to be pressed directly against the shaft portion of the locking member when the locking device is locked, and ii) to generate a friction force between the locking piece and the locking member to prevent the locking member from moving, wherein the locking piece is provided with an opening transverse to its axis, and the shaft portion of the locking member is arranged through said opening, the locking member and the locking piece being transverse to one another, the opening of the locking piece is dimensioned larger than the cross section of the shaft portion of the locking member, and between a first end of the locking piece and the frame is a support point, which allows the locking piece to rotate, the support point being arranged to prevent the first end of the locking piece from moving away from the first contact surface, and the locking device comprises at least one actuator, which is arranged to generate a force effect in the locking piece when the locking device is locked for keeping the locking piece in an oblique position relative to the axis of the locking member, whereby the movement of the locking member away from the first contact surface is prevented when the locking piece is pressed against the outer surface of the shaft portion of the locking member.

7. A safety storage device as claimed in claim 6, wherein the actuator is a spring member, when the locking device is locked, the spring member is arranged to move the second end of the locking piece away from the first contact surface, and the longitudinal force effect applied to the locking member towards the first contact surface is arranged to make the second end of the locking piece move towards the first contact surface thus releasing the pressing between the locking member and the locking piece and thus allowing the locking member to move towards the first contact surface.

8. A safety storage device as claimed in claim 6, wherein the locking device comprises a mechanical lock, which is openable with a key.

9. A safety storage device as claimed in claim 6, wherein the locking device comprises a reading device for reading an electronic identifier.

10. A safety storage device as claimed in claim 6, wherein the locking device comprises an automated payment machine.

* * * * *